US009879550B2

(12) United States Patent
Plante

(10) Patent No.: US 9,879,550 B2
(45) Date of Patent: Jan. 30, 2018

(54) OUTER SHROUD WITH GUSSET

(71) Applicant: PRATT & WHITNEY CANADA CORP., Longueuil (CA)

(72) Inventor: Ghislain Plante, Verdun (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 427 days.

(21) Appl. No.: 14/448,615

(22) Filed: Jul. 31, 2014

(65) Prior Publication Data

US 2016/0032733 A1 Feb. 4, 2016

(51) Int. Cl.
*F01D 5/22* (2006.01)

(52) U.S. Cl.
CPC ..... *F01D 5/225* (2013.01); *F05D 2270/114* (2013.01)

(58) Field of Classification Search
CPC ..... F01D 5/22; F01D 5/225; F05D 2240/80; F05D 2240/305; F05D 2240/306; F05D 2240/114
See application file for complete search history.

(56) References Cited

U.S. PATENT DOCUMENTS

| | | | | |
|---|---|---|---|---|
| 1,187,451 | A * | 6/1916 | Search | F01D 5/225 416/192 |
| 6,241,471 | B1 | 6/2001 | Herron | |
| 6,857,853 | B1 | 2/2005 | Tomberg et al. | |
| 7,066,713 | B2 | 6/2006 | Dube et al. | |
| 7,134,838 | B2 | 11/2006 | Dube et al. | |
| 7,396,205 | B2 | 7/2008 | Dube et al. | |
| 7,527,477 | B2 | 5/2009 | Norton et al. | |
| 2013/0319008 | A1 * | 12/2013 | Faulder | F01D 5/147 60/805 |

* cited by examiner

*Primary Examiner* — Kenneth Bomberg
*Assistant Examiner* — John S Hunter
(74) *Attorney, Agent, or Firm* — Norton Rose Fulbright Canada LLP

(57) ABSTRACT

A turbine blade comprises an airfoil. An outer shroud at a tip of the airfoil, has a main surface facing the airfoil and forming a first plateau. A gusset or gussets have a periphery raising from the main surface, and a second plateau between the periphery and the airfoil. A gas turbine engine with such turbine blade is also provided.

20 Claims, 5 Drawing Sheets

OUTER SHROUD WITH GUSSET

TECHNICAL FIELD

The present application generally relates to gas turbine engines and, more particularly, to gas turbine engines of the type having shrouded blades.

BACKGROUND OF THE ART

In some gas turbine engines, an outer shroud is added to an airfoil in order to reduce tip leakage loss. The addition of the outer shroud may increase the centrifugal load on the turbine, thereby causing higher stresses in the airfoil. Also, the tangential extension from the airfoil supporting such an outer shroud may generate a bending stress at the intersection of the airfoil and of the shroud. In order to reduce the stress concentration at the airfoil at the shroud intersection, fillets of variable radius have been used. However, such fillets may result in a reduction of the flow area. Accordingly, there is a need to provide an improved outer shroud configuration.

The manufacturing process to produce a blade is typically a casting process. A casting is a manufacturing process by which a liquid material—in this case a metal in liquid phase—is usually poured into a mold, which contains a hollow cavity of the desired shape, and then allowed to solidify. If the pouring happened from the shroud extremity, then the shroud external shape as presented into the U.S. Pat. No. 7,527,477 B2 could require an expensive machining.

SUMMARY

Therefore, in accordance with the present disclosure, there is provided a turbine blade comprising: an airfoil; an outer shroud at a tip of the airfoil, the shroud having a main surface facing the airfoil and forming a first plateau; and at least one gusset having a periphery raising from the main surface, and a second plateau between the periphery and the airfoil.

Further in accordance with the present disclosure, there is provided a gas turbine engine comprising a turbine section with a plurality of blades, each said blade comprising: an airfoil; an outer shroud at a tip of the airfoil, the shroud having a main surface facing the airfoil and forming a first plateau; and at least one gusset having a periphery raising from the main surface, and a second plateau between the periphery and the airfoil.

Further details of these and other aspects of the present invention will be apparent from the detailed description and figures included below.

DESCRIPTION OF THE DRAWINGS

Reference is now made to the accompanying figures, in which.

DETAILED DESCRIPTION

Figure 1:
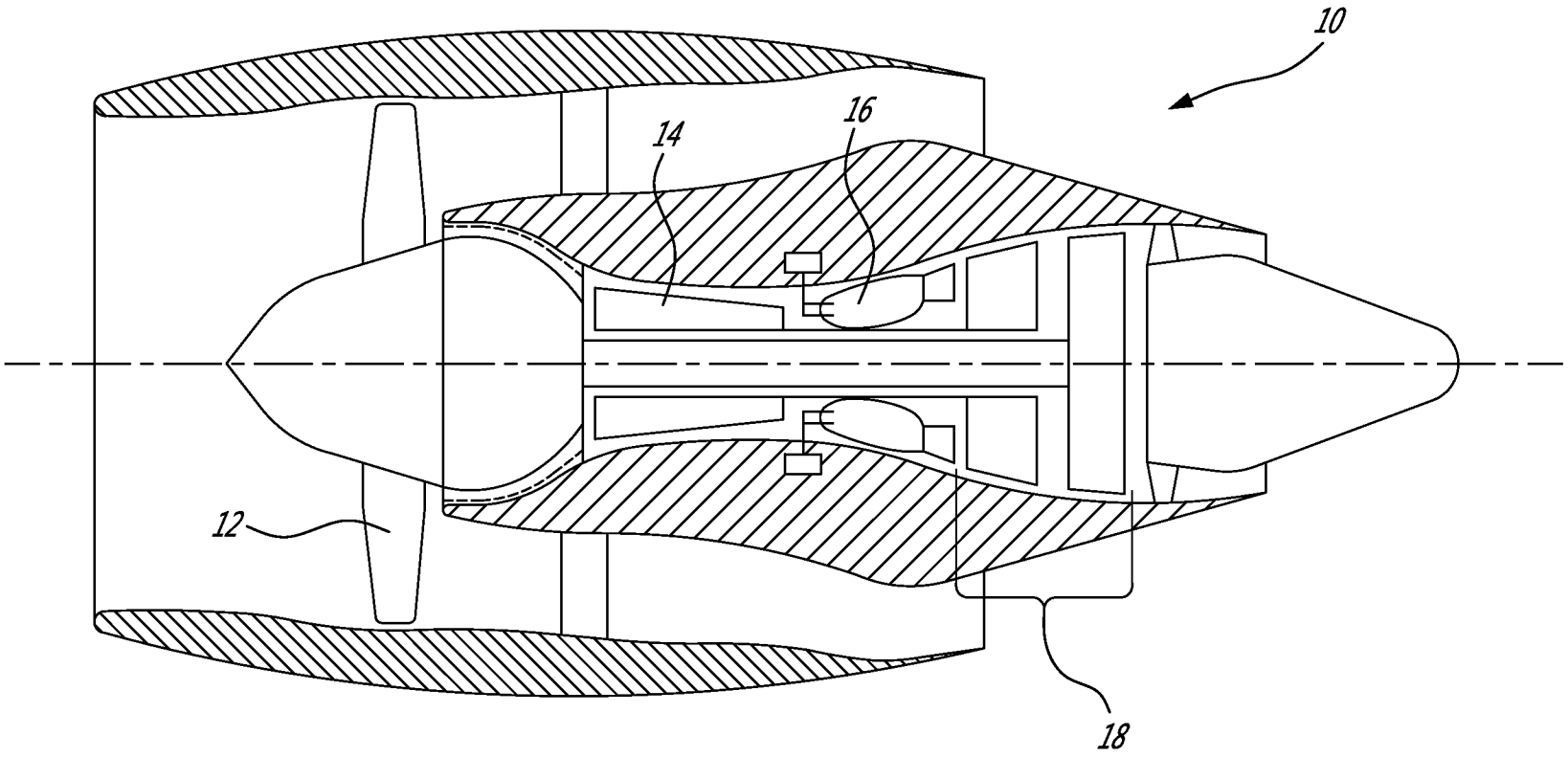
FIG. 1 is a schematic cross-sectional view of a turbofan gas turbine engine.

FIG. 1 illustrates a turbofan gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases. Note that while a turbofan engine is illustrated, the present application could also be used for any others usages of a gas turbine such as turboprop, turboshaft, etc.

Figure 2:
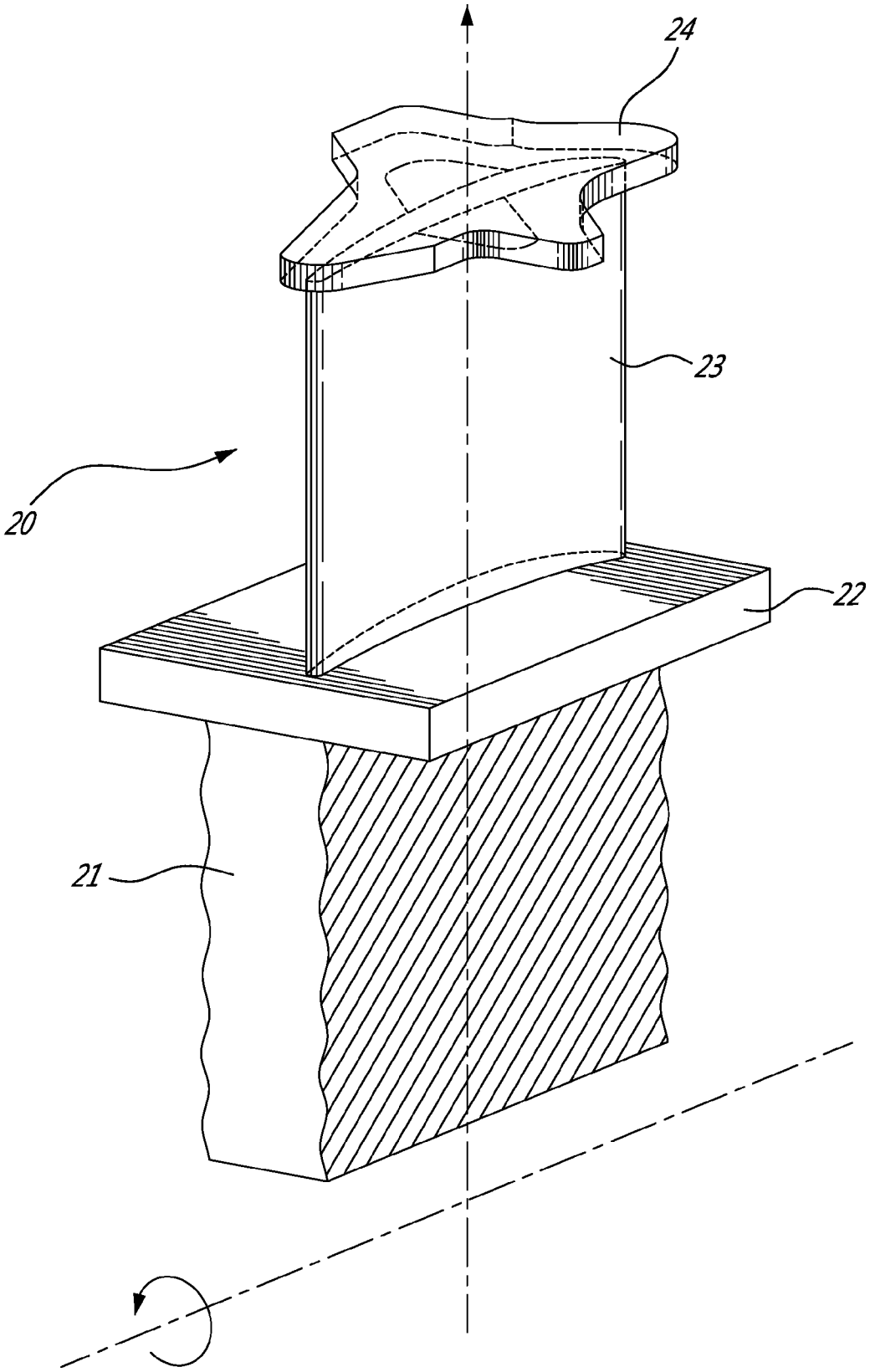
FIG. 2 is a schematic view of a blade as found in a turbine section of the gas turbine engine of FIG. 1, and in accordance with the present disclosure.

Referring to FIG. 2, a blade of a turbine is generally shown at 20, the turbine being of the type commonly found in the turbine section 18 of the gas turbine engine 10 of FIG. 1. The blade 20 may have a root 21, a platform 22, an airfoil 23 and an outer shroud 24. Other configurations are considered as well. The root 21 is for instance secured to a disc, with the turbine having multiple of the airfoils 20 for a given disc. The outer shroud 24 is at a tip 30 (FIG. 3) of the airfoil 23. For reference purposes, the outer shroud 24 is said to be radially outward of the airfoil 23, while the root 21 is radially inward of the airfoil 23.

Figure 3:
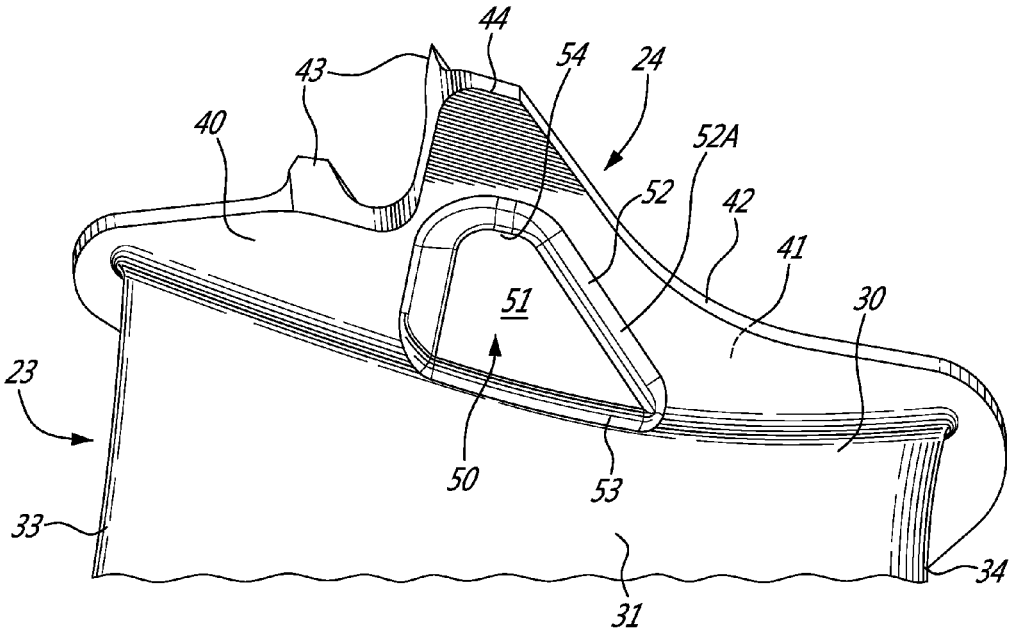
FIG. 3 is an enlarged perspective view of an outer shroud with gusset in the blade of FIG. 2, on the pressure side.
Figure 4:
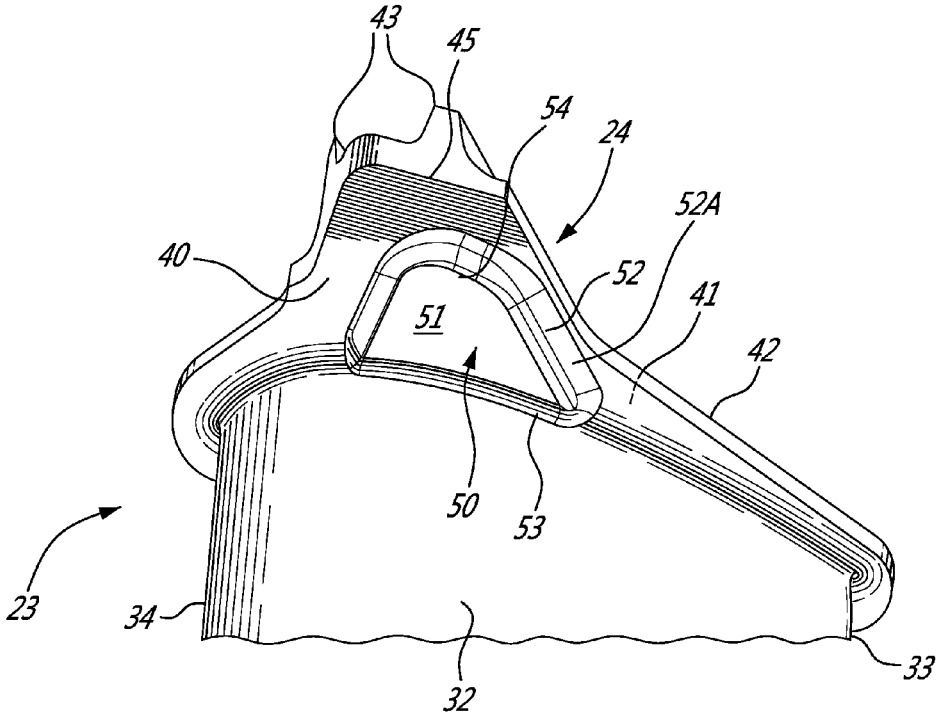
FIG. 4 is an enlarged perspective view of an outer shroud with gusset in the blade of FIG. 2, on the suction side.
Figure 5:
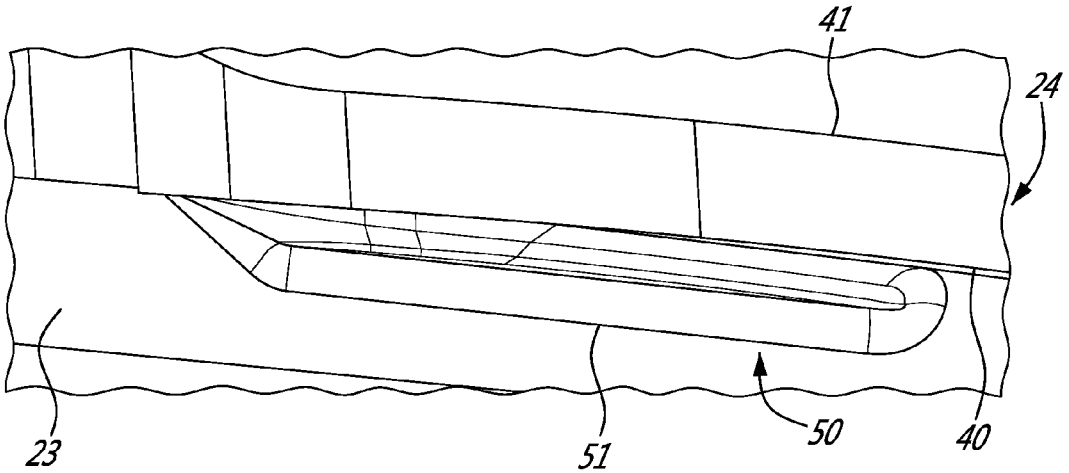
FIG. 5 is a sectional view of the gusset of either one of FIGS. 3 and 4.

Referring to FIGS. 2 to 4, the airfoil 23 is shown in greater detail as having its tip 30 radially outward from the root 21. The airfoil 23 has a pressure side 31 and a suction side 32, with a leading edge 34 and a trailing edge 33 generally separating the pressure side 31 from the suction side 32. The pressure side 31 has a concave surface, while the suction side 32 has a convex surface.

Still referring to FIGS. 2 to 4, the outer shroud 24 is seen as having a main inner surface 40 and a main outer surface 41, with a peripheral edge 42 between the surfaces 40 and 41. The main inner surface 40 is radially inward, facing toward a centerline of the turbine, while the main outer surface 41 is radially outward and performs the shrouding action with a case component of the gas turbine engine. Accordingly, the main outer surface 41 may comprise fins 43 (a.k.a. ribs, etc), by which a clearance is defined with the surrounding case or the like. The peripheral edge 42 of the outer shroud 24 may have any appropriate peripheral shape. It is observed that the peripheral edge 42 of the outer shroud 24 may have a pressure side tip 44 (FIG. 3) and a suction side tip 45 (FIG. 4).

Figure 6:
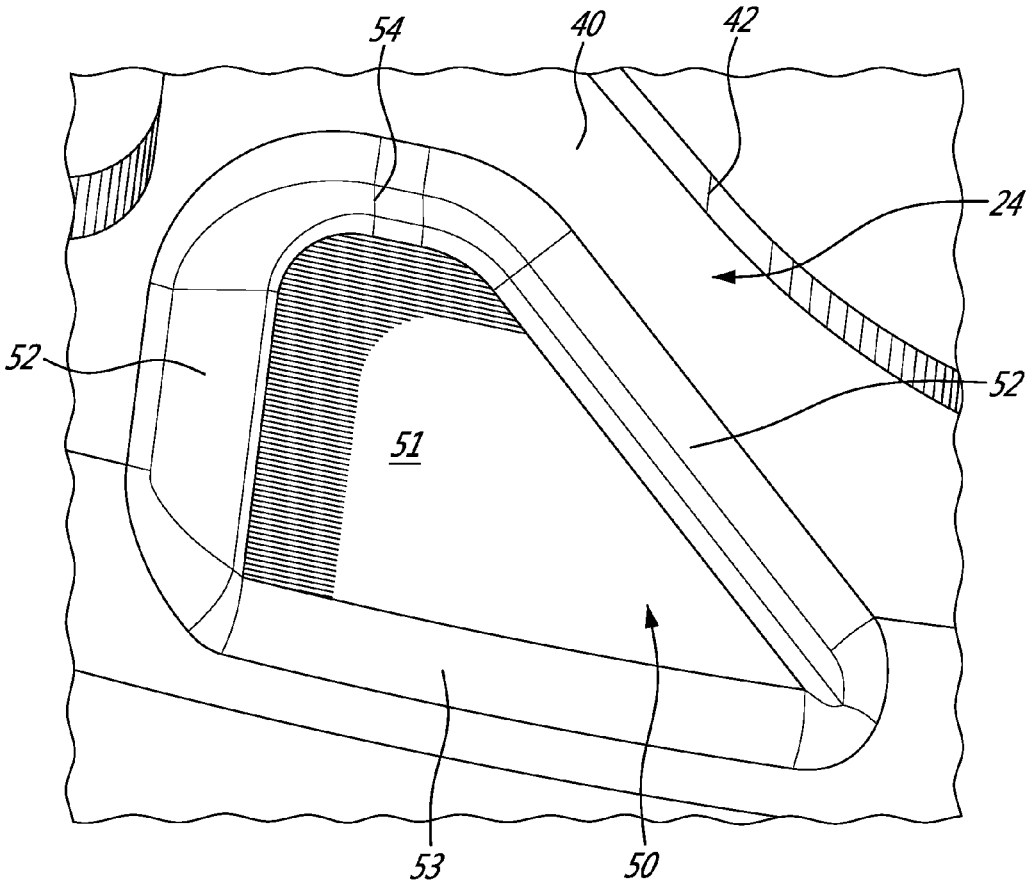
FIG. 6 is an enlarged perspective view of the gusset of either one of FIGS. 3 and 4.
Figure 7:
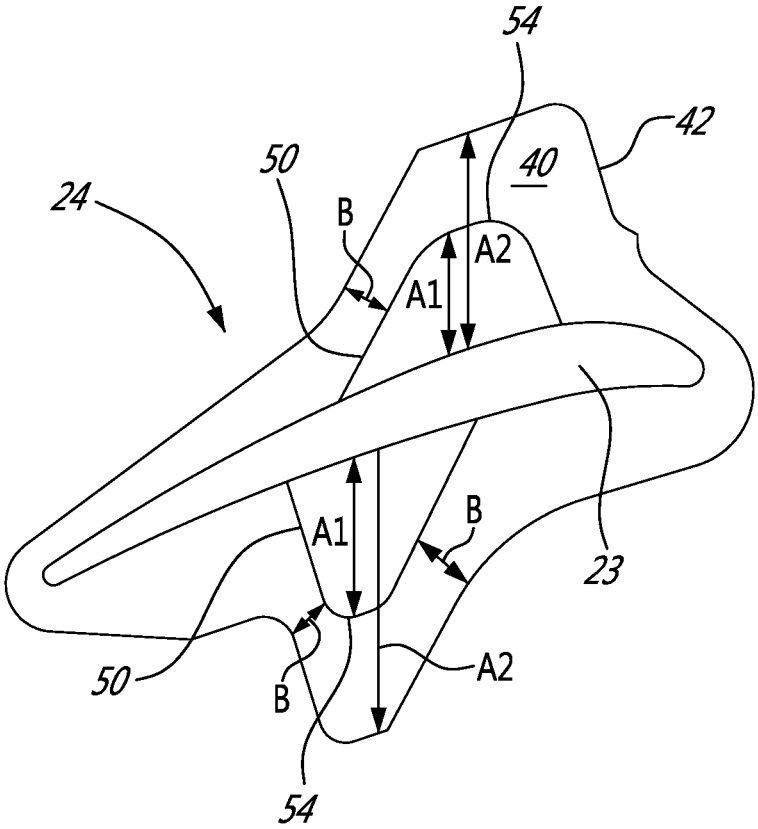
FIG. 7 is a footprint view of the blade at an intersection between airfoil and the gussets.

Referring to FIGS. 2 to 7, a gusset 50 is defined on the main inner surface 40 of the outer shroud 24. Although a single gusset 50 is shown, more than one gussets may be provided on the same outer shroud 24. For instance, FIG. 7 shows gussets 50 on both the pressure side 31 and the suction side 32 of the airfoil 23. Each of the gussets 50 are generally defined by a plateau 51 projecting in a radial inward direction from the main inner surface 40. The plateau 51 is bounded by a periphery 52 transitioning the plateau 51 to the main inner surface 40. For clarity, the use of plateau 51 herein means a generally smooth and continuous surface that does not have any abrupt incline. However, the expression "plateau" should not be used to refer to a substantially planar surface, as the outer shroud 24 is typically arcuate due to the generally circular shape of the turbine including the outer shroud 24. The plateau 51 also defines an increased thickness of the shroud 24 relative to the part of the main inner surface 40 surrounding the plateau 51 (the main inner surface 40 forming another plateau). For instance, a thickness of the plateau 51 (i.e., in a radial direction) is between 0.010" and 0.060".

In an embodiment, the periphery 52 may have a flare 52A raising from the main inner surface 40 (e.g., with fillet). The flare 52A may be on three faces of the gusset 50, for instance as shown in FIG. 6, and may have an angle ranging between 20 and 70 degrees from the main inner surface 40. At an intersection of the gusset 50 with the airfoil 23, a fillet 53 may be provided. The fillet is of smaller dimensions that the fillets used in prior art shrouded airfoils without the gusset 50. There may also be a fillet at the junction between the main inner surface 40 and the periphery 52.

In FIG. 7, the gussets 50 are shown as having a tip 54 for the plateau 51. The tip 54 may be in a tangential direction relative to a rotation orientation of the blade 20 in the turbine section 18. The distance A1 from the airfoil 23 to the tip 54 of the plateau 51 may be 35% to 65% of the distance A2 from the airfoil 23 to the shroud tip 44 or 45. The typical minimal distance B between the plateau 51 and the peripheral edge 42 of the shroud 24 may be 0.040" to 0.250".

The above description is meant to be exemplary only, and one skilled in the art will recognize that changes may be made to the embodiments described without departing from the scope of the invention disclosed. For example, the shroud 24 may be integral, or monolithic with the airfoil 23. The airfoil with the outer shroud and gusset may be used in other types of gas turbine engines, etc. Still other modifications which fall within the scope of the present invention will be apparent to those skilled in the art, in light of a review of this disclosure, and such modifications are intended to fall within the appended claims.

The invention claimed is:

1. A turbine blade comprising:

an airfoil;

an outer shroud at a tip of the airfoil, the shroud having a main surface facing the airfoil and forming a first plateau with a first incline in a circumferential direction, the main surface delimited by a peripheral edge surrounding the first plateau; and at least one gusset having a periphery raising from the first plateau, and a second plateau between the periphery and the airfoil, the second plateau being circumferentially aligned with the first plateau and having a second incline in the circumferential direction, the periphery transitioning the second plateau to the first plateau with a third incline in the circumferential direction, the third incline of the periphery in the circumferential direction being greater than the first incline of the first plateau and than the second incline of the second plateau in a the circumferential direction, the first plateau having a surface located circumferentially between the peripheral edge of the first plateau and the periphery of the second plateau.

2. The turbine blade according to claim 1, wherein the periphery of the gusset raising from the main surface defines a flare from the first plateau to the second plateau.

3. The turbine blade according to claim 2, comprising a fillet between the periphery and the main surface.

4. The turbine blade according to claim 2, wherein the flare has an angle between 20 and 70 degrees.

5. The turbine blade according to claim 1, wherein a thickness of the gusset from the first plateau to the second plateau is between 0.010" and 0.060".

6. The turbine blade according to claim 1, wherein a tip of the gusset is in a tangential direction relative to a rotation orientation of the turbine blade in a turbine section.

7. The turbine blade according to claim 6, wherein a distance between a footprint of the airfoil and the second plateau at the tip of the gusset is at a distance of 35%-65% of a distance between a footprint of the airfoil and a tip of the main surface.

8. The turbine blade according to claim 1, wherein the airfoil has a pressure side and a suction side, and further comprising two of said gusset, with one said gusset on the pressure side and another said gusset on the suction side.

9. The turbine blade according to claim 1, wherein a shortest distance between the second plateau and the peripheral edge of the main surface ranging from 0.040" to 0.250".

10. The turbine blade according to claim 1, further comprising a fillet between the second plateau and the airfoil.

11. A gas turbine engine comprising a turbine section with a plurality of blades, each said blade comprising:

an airfoil;

an outer shroud at a tip of the airfoil, the shroud having a main surface facing the airfoil and forming a first plateau; and at least one gusset having a periphery raising from the first plateau, and a second plateau between the periphery and the airfoil, the second plateau being circumferentially aligned with the first plateau and having a second incline in the circumferential direction, the periphery transitioning the second plateau to the first plateau with a third incline in the circumferential direction, the third incline of the periphery in the circumferential direction being greater than the first incline of the first plateau and than the second incline of the second plateau in a the circumferential direction, the first plateau having a surface located circumferentially between the peripheral edge of the first plateau and the periphery of the second plateau.

12. The gas turbine engine according to claim 11, wherein the periphery of the gusset raising from the main surface defines a flare from the first plateau to the second plateau.

13. The gas turbine engine according to claim 12, comprising a fillet between the periphery and the main surface.

14. The gas turbine engine according to claim 12, wherein the flare has an angle between 20 and 70 degrees.

15. The gas turbine engine according to claim 11, wherein a thickness of the gusset from the first plateau to the second plateau is between 0.010" and 0.060".

16. The gas turbine engine according to claim 11, wherein a tip of the gusset is in a tangential direction relative to a rotation orientation of the blade in a turbine section.

17. The gas turbine engine according to claim 16, wherein a distance between a footprint of the airfoil and the second plateau at the tip of the gusset is at a distance of 35%-65% of a distance between a footprint of the airfoil and a tip of the main surface.

18. The gas turbine engine according to claim 11, wherein the airfoil has a pressure side and a suction side, and further comprising two of said gusset, with one said gusset on the pressure side and another said gusset on the suction side.

19. The gas turbine engine according to claim 11, wherein a shortest distance between the second plateau and a peripheral edge of the main surface ranging from 0.040" to 0.250".

20. The gas turbine engine according to claim 11, further comprising a fillet between the second plateau and the airfoil.

* * * * *